US011443883B2

(12) United States Patent
Fujii et al.

(10) Patent No.: US 11,443,883 B2
(45) Date of Patent: Sep. 13, 2022

(54) REACTOR DEVICE

(71) Applicant: Panasonic Intellectual Property Management Co., Ltd., Osaka (JP)

(72) Inventors: Takeshi Fujii, Tokyo (JP); Ryosuke Usui, Hokkaido (JP); Chihiro Satou, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 338 days.

(21) Appl. No.: 16/768,903

(22) PCT Filed: Dec. 17, 2018

(86) PCT No.: PCT/JP2018/046221
§ 371 (c)(1),
(2) Date: Jun. 2, 2020

(87) PCT Pub. No.: WO2019/176203
PCT Pub. Date: Sep. 19, 2019

(65) Prior Publication Data

US 2021/0151237 A1 May 20, 2021

(30) Foreign Application Priority Data

Mar. 14, 2018 (JP) ..... JP2018-046177

(51) Int. Cl.
*H01F 27/22* (2006.01)
*H01F 27/24* (2006.01)
(Continued)

(52) U.S. Cl.
CPC ..... *H01F 27/22* (2013.01); *H01F 27/24* (2013.01); *H01F 27/32* (2013.01); *H01F 41/12* (2013.01)

(58) Field of Classification Search
CPC ..... H01F 27/29; H01F 41/076; H01F 17/043; H01F 27/022; H01F 27/24;
(Continued)

(56) References Cited

U.S. PATENT DOCUMENTS 6,270,083 B1 * 8/2001 Hirschvogel ..... F16J 15/22 277/540
2001/0016618 A1 * 8/2001 Mercuri ..... C04B 40/0616 524/495
(Continued)

FOREIGN PATENT DOCUMENTS

CN 103282983 A 9/2013
JP 2011-066242 3/2011
JP 2012-211259 A 11/2012

OTHER PUBLICATIONS

English Translation of Chinese Office Action dated Oct. 27, 2021 for the related Chinese Patent Application No. 201880087988.6.
(Continued)

*Primary Examiner* — Michael P McFadden
(74) *Attorney, Agent, or Firm* — McDermott Will & Emery LLP

(57) ABSTRACT

A reactor device includes a coil, a magnetic core having the coil thereon, a case accommodating the coil and the magnetic core, a cooling plate fixed to the case, an insulating sheet disposed between the coil and the cooling plate, a compressible graphite sheet disposed between the coil and the cooling plate, and a screw to fix the cooling plate to the case. The case has a screw hole and an opening provided therein. The screw passes through the screw hole to fix the cooling plate to the case. The coil contacts the insulating sheet through the opening of the case. The graphite sheet contacts the cooling plate. The reactor has high cooling performance and reliability.

9 Claims, 2 Drawing Sheets

(51) Int. Cl.
*H01F 27/32* (2006.01)
*H01F 41/12* (2006.01)

(58) Field of Classification Search
CPC ..... H01F 27/2823; H01F 41/005; H01F 41/0206; H01F 41/10; H01F 27/255
See application file for complete search history.

(56) References Cited

U.S. PATENT DOCUMENTS

2007/0122936 A1* 5/2007 Park ..... H01L 21/67207 438/77
2013/0293335 A1* 11/2013 Yoshikawa ..... H01F 27/02 29/602.1
2015/0170817 A1* 6/2015 Yamashima ..... H01F 27/008 336/61

OTHER PUBLICATIONS

International Search Report of PCT application No. PCT/JP2018/046221 dated Mar. 19, 2019.

* cited by examiner

REACTOR DEVICE

CROSS-REFERENCE TO RELATED APPLICATIONS

This application is a U.S. national stage application of the PCT international application No. PCT/JP2018/046221 filed on Dec. 17, 2018, which claims the benefit of foreign priority of Japanese patent application No. 2018-046177 filed on Mar. 14, 2018, the contents all of which are incorporated herein by reference.

TECHNICAL FIELD

The present invention relates to a reactor device including a reactor to be cooled.

BACKGROUND ART

In recent years, vehicles such as electric vehicles and hybrid vehicles have become increasingly popular which employ motors as their main and/or auxiliary drive sources for traveling. Reactors used in these vehicles are required to withstand a high electric current that generates heat, accordingly increasing importance of countermeasures against the heat. Countermeasures are taken to cool the reactors; that is, the reactors are each connected to a cooling plate with a heat-dissipation member, such as a gel sheet, thereby cooling the reactors.

A conventional reactor similar to the reactors described above is disclosed in, e.g. PTL 1.

CITATION LIST

Patent Literature

PTL 1: Japanese Patent Laid-Open Publication No. 2011-66242

SUMMARY

A reactor device includes a coil, a magnetic core having the coil thereon, a case accommodating the coil and the magnetic core, a cooling plate fixed to the case, an insulating sheet disposed between the coil and the cooling plate, a compressible graphite sheet disposed between the coil and the sheet cooling plate, and a screw to fix the cooling plate to the case. The case has a screw hole and an opening provided therein. The screw passes through the screw hole to fix the cooling plate to the case. The coil contacts the insulating sheet through the opening of the case. The graphite sheet contacts the cooling plate.

The reactor has high cooling performance and reliability.

DETAIL DESCRIPTION OF PREFERRED EMBODIMENTS

Figure 1:
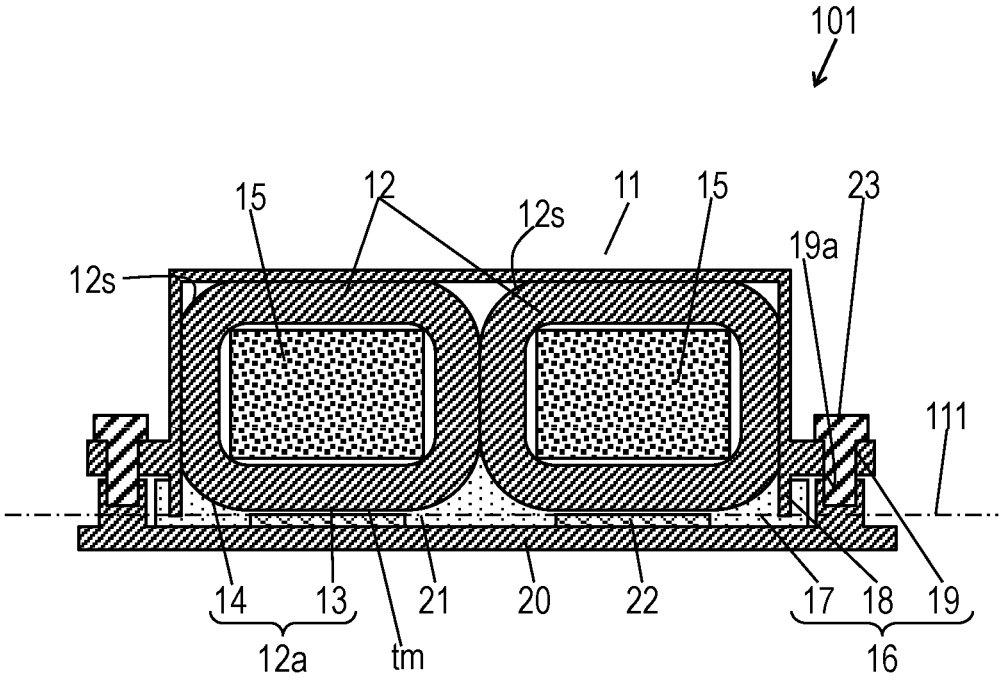
FIG. 1 is a side cross-sectional view of a reactor device according to an exemplary embodiment.
Figure 2:
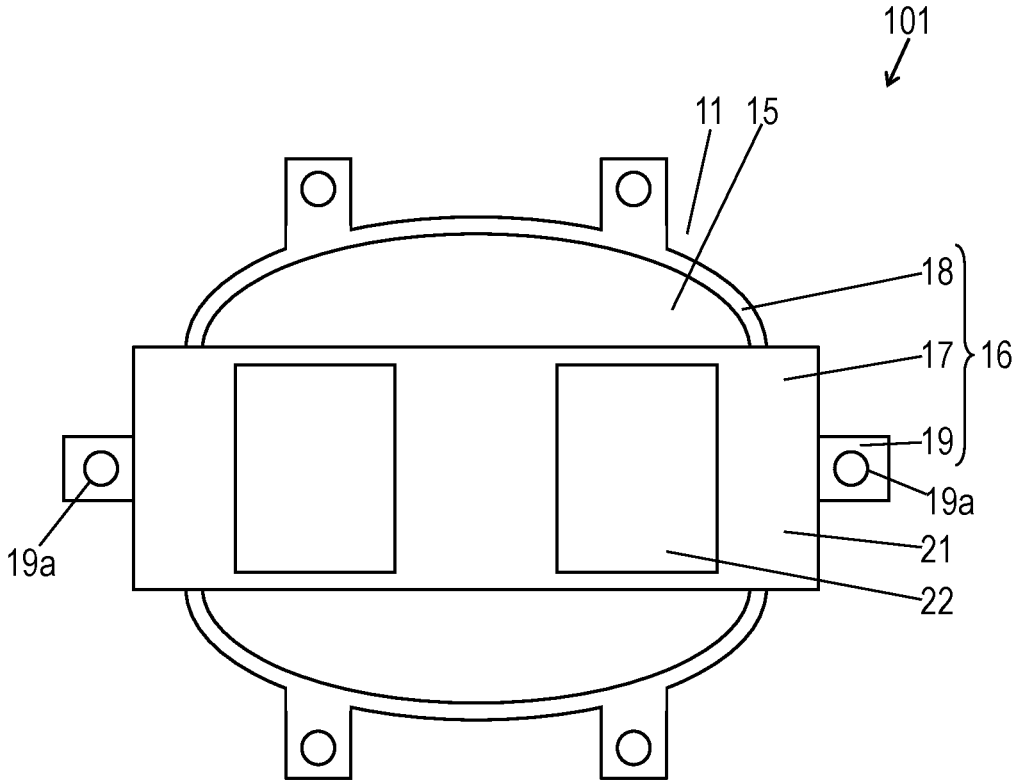
FIG. 2 is a bottom view of the reactor device according to the embodiment.

FIG. 1 is a side cross-sectional view of reactor device 101 according to an exemplary embodiment. FIG. 2 is a bottom view of reactor device 101.

Reactor device 101 includes reactor 11, cooling plate 20 having reactor 11 mounted thereon, insulating sheet 21 disposed between reactor 11 and cooling plate 20, and graphite sheet 22 disposed between reactor 11 and cooling plate 20. FIG. 2 shows reactor device 101 where cooling plate 20 is removed. Reactor 11 includes coil 12 wound edgewise, core 15 having a ring shape, and case 16 accommodating the coil and the core therein. Case 16 includes peripheral part 18 surrounding coil 12, and screw-hole parts 19 for attaching case 16 to cooling plate 20. Case 16 has opening 17 through which coil 12 is exposed. Peripheral part 18 surrounds opening 17. Opening 17 and screw-hole parts 19 are disposed on the lower surface of case 16. The lower surface is used as mounting surface 111 of reactor 11.

When viewed from bottom, coil 12 includes flat portion 13 substantially parallel to mounting surface 111, and bent portions 14 curved upward at both edges of flat portion 13. Flat portion 13 and bent portions 14 are exposed through opening 17. Surface 12*s* of coil 12 includes contact portion 12*a* contacting insulating sheet 21. Contact portion 12*a* of surface 12*s* of coil 12 includes flat portion 13 being flat, and bent portions 14 curved and connected to flat portion 13.

Reactor 11 is attached to cooling plate 20 while both insulating sheet 21 and graphite sheet 22 are sandwiched between the reactor and the cooling plate. Reactor 11, insulating sheet 21, graphite sheet 22, and cooling plate 20 are disposed in this order from above in FIG. 1. Coil 12 of reactor 11 contacts insulating sheet 21. Graphite sheet 22 contacts cooling plate 20. This configuration allows heat generated by coil 12 of reactor 11 to transmit to insulating sheet 21, and then to graphite sheet 22. Graphite sheet 22 has preferable thermal conductivity in a surface direction, so that the heat diffuses in the surface direction before it transmits from the sheet to cooling plate 20. For this reason, the reactor device cools coil 12 more efficiently than the conventional reactors described above.

Screws 23 are passed through screw holes 19*a* formed in screw-hole parts 19 and screwed tightly into cooling plate 20, thereby attaching cooling plate 20 to reactor 11 to press cooling plate 20 against both case 16 and coil 12. Insulating sheet 21 is made of silicone, and has a thickness of about 1.5 mm. Insulating sheet 21 has a hardness of 15 under the Japanese Industrial Standard (JIS) type-E durometer, and a thermal conductivity of about 5 W/m·K.

Graphite sheet 22 is made of a pyrolytic graphite sheet having a thickness of about 0.5 mm. The compressibility of graphite sheet 22 is about 60% upon a pressure of 1 MPa applied to graphite sheet 22.

Compressibility PC referred to herein is determined as follows. A pressure is applied to a sheet with thickness t0. Then, the applied pressure is removed, and the thickness t1 of the sheet is measured. Compressibility PC is expressed as the formula, $PC=(t0-t1)/t0$. The value of the compressibility PC is defined as the compressibility at the applied pressure. In accordance with the embodiment, the compressibility PC is expressed in percent.

In the configuration described above, both insulating sheet 21 and graphite sheet 22 compressively deform by tightening with screws 23. Graphite sheet 22 is compressed only in a thickness direction with almost no change in the area of the sheet. On the other hand, insulating sheet 21 deforms in the following manner: The sheet is compressed in the thickness direction; parts of insulating sheet 21 deform along the shape of respective bent portions 14 of coil 12 while the area of the sheet expands toward a periphery of the sheet. Therefore, even in the case where insulating sheet 21 and graphite sheet 22 have the same shape, the periphery of graphite sheet 22 is covered with the insulating sheet, thereby preventing graphite sheet 22 from scattering graphite powder from graphite sheet 22. Coil 12 is made of a conductive wire wounded on magnetic core 15. Surface 12*s* of the coil including contact portion 12*a* of coil 12 has fine projections and depressions which are developed by the winding and stacking of the conductive wire. Insulating sheet 21 thus deforms along the contact portion 12*a* of coil 12 along the projections and depressions.

Such a surface of insulating sheet 21 contacting coil 12 deforms along bent portions 14 and the shape of the projections and depressions across the stacked wires. This configuration increases the area of the surface of insulating sheet 21 contacting coil 12, and decreases thermal contact resistance between the insulating sheet and the coil accordingly, thereby cooling coil 12 efficiently.

Graphite sheet 22 compressively deforms. Even in the case where cooling plate 20 has a surface with projections and depressions, the surface of graphite sheet 22 deforms along the projections and depressions. This configuration decreases thermal contact resistance between graphite sheet 22 and cooling plate 20, thereby cooling coil 12 efficiently.

The hardness of insulating sheet 21 is preferably equal to or larger than 2 and equal to or smaller than 25 measured under the JIS type-E durometer. In cases where the hardness of insulating sheet 21 exceeds 25 measured under the JIS type-E durometer, the sheet insufficiently deforms despite the tightening by screws 23, and may decrease thermal conductivity from coil 12 to insulating sheet 21. On the other hand, in cases where the hardness of insulating sheet 21 is less than 2, insulating sheet 21 excessively deforms, and may prevent graphite sheet 22 from being compressed sufficiently, accordingly decreasing thermal conductivity from graphite sheet 22 to cooling plate 20.

Graphite sheet 22 preferably has a compressibility equal to or larger than 50% upon a pressure of 1 MPa applied to graphite sheet 22. This configuration allows both insulating sheet 21 and graphite sheet 22 to compressively deform, accordingly cooling coil 12 efficiently.

Insulating sheet 21 preferably has a larger size than graphite sheet 22 after being tightened with screws 23. Insulating sheet 21 preferably has a larger area than contact portion 12*a* of coil 12 extending over both flat portion 13 and bent portions 14 of coil 12. Graphite sheet 22 preferably has a smaller size than flat portion 13. These configurations allow graphite sheet 22 to be pressed with flat portion 13, so that the entire of the graphite sheet is strongly compressed. The regions of insulating sheet 21 facing bent portions 14 less receive the applied pressure to graphite sheet 22, but directly contact cooling plate 20, thereby cooling coil 12 efficiently.

The minimum thickness of insulating sheet 21 after the sheet have been tightened with screws 23 is preferably equal to or larger than the thickness of graphite sheet 22 and is equal to or smaller than five times the thickness of graphite sheet 22. The minimum thickness of insulating sheet 21 smaller than the thickness of the graphite sheet may degrade the insulating properties of the insulating sheet. The minimum thickness of insulating sheet 21 larger than five times the thickness of the graphite sheet may prevent coil 12 from being cooled efficiently. The terms "the thicknesses after the sheet have been tightened with screws 23" as used herein means that the thickness equal the thickness measured as follows: Insulating sheet 21 is once tightened with screws 23, and then the screws are removed to release the tightening. After that, the thicknesses of insulating sheet 21 and graphite sheet 22 are measured.

Insulating sheet 21 is preferably sandwiched between peripheral part 18 and cooling plate 20. The tightening of insulating sheet 21 with screws 23 while the insulating sheet is sandwiched between peripheral part 18 and cooling plate 20 causes parts of insulating sheet 21 to be squeezed out toward bent portions 14 and to move upward along bent portions 14, thereby facilitating the cooling of coil 12 efficiently.

In the above conventional reactor including a gel sheet, the gel sheet has insufficient thermal conductivity. Repetitive heat-generation and cooling of the coil in service cause repetitive thermal expansions that may cause the gel sheet to be gradually squeezed outward. This leads to a possible decrease in the thermal conductivity for the reactor.

In reactor device 101 according to the embodiment, as described above, coil 12 i.e. reactor 11 is efficiently cooled.

Graphite sheet 22 according to the embodiment may include a gel sheet and graphite powder saving as thermal conductive filler contained in the gel sheet. Such a sheet has high thermal conductivity and high electrical conductivity.

As described above, reactor device 101 includes coil 12, magnetic core 15 having coil 12 disposed thereon, case 16 accommodating coil 12 and magnetic core 15 therein, cooling plate 20 fixed to case 16, insulating sheet 21 disposed between coil 12 and cooling plate 20, compressible graphite sheet 22 disposed between coil 12 and insulating sheet 21, and screw 23 that pass through screw hole 19*a* in case 16 to fix cooling plate 20 to case 16. Opening 17 is formed in case 16. Coil 12 contacts insulating sheet 21 through opening 17 of case 16. Graphite sheet 22 contacts cooling plate 20.

Surface 12*s* of coil 12 includes contact portion 12*a* contacting insulating sheet 21. Contact portion 12*a* of coil 12 includes flat portion 13 being flat, and bent portions 14 that are curved and connected to flat portion 13. Insulating sheet 21 has a larger area than contact portion 12*a* of coil 12. Graphite sheet 22 has a smaller area than flat portion 13.

Insulating sheet 21 deforms along the shape of contact portion 12*a* of coil 12.

A surface of graphite sheet 22 contacts insulating sheet 21, and faces flat portion 13 across insulating sheet 21.

The minimum thickness of insulating sheet 21 is equal to or larger than the thickness of graphite sheet 22 and is equal to or smaller than five times the thickness of graphite sheet 22 after the insulating sheet is once tightened with screw 23, and then is released from the tightening with screw 23.

Case 16 includes peripheral part 18 surrounding coil 12. Insulating sheet 21 is sandwiched between peripheral part 18 of case 16 and cooling plate 20.

REFERENCE MARKS IN THE DRAWINGS

11 reactor
12 coil
13 flat portion
14 bent portion
15 magnetic core
16 case
17 opening
18 peripheral part
19 screw-hole part
19*a* screw hole
20 cooling plate
21 insulating sheet
22 graphite sheet
23 screw
101 reactor device

The invention claimed is:

1. A reactor device comprising: a coil; a magnetic core having the coil provided thereon; a case accommodating the coil and the magnetic core therein, the case having a screw hole and an opening; a cooling plate fixed to the case; an insulating sheet disposed between the coil and the cooling plate; a graphite sheet disposed between the coil and the cooling plate, the graphite sheet being compressible; and a screw passing through the screw hole to fix the cooling plate to the case, wherein the coil contacts the insulating sheet through the opening of the case, and the graphite sheet contacts the cooling plate, wherein the graphite sheet has a compressibility equal to or larger than 50% upon having a pressure of 1 MPa applied to the graphite sheet.

2. The reactor device according to claim 1, wherein the insulating sheet has a hardness equal to or larger than 2 and equal to or smaller than 25 under Japanese Industrial Standard (JIS) type-E.

3. The reactor device according to claim 1, wherein a periphery of the graphite sheet is covered with the insulating sheet.

4. The reactor device according to claim 1, wherein the insulating sheet contacts the graphite sheet.

5. The reactor device according to claim 1, wherein a surface of the coil includes a contact portion contacting the insulating sheet, the contact portion of the coil includes a flat portion and a bent portion connected to the flat portion, the insulating sheet has a larger area than the contact portion of the coil, and the graphite sheet has a smaller area than the flat portion.

6. The reactor device according to claim 5, wherein a part of the insulating sheet deforms along a shape of the contact portion of the coil.

7. The reactor device according to claim 5, wherein the graphite sheet has a surface contacting the insulating sheet and facing the flat portion across the insulating sheet.

8. The reactor device according to claim 1, wherein a minimum thickness of the graphite sheet has a thickness and the insulating sheet has a thickness having a minimum thickness; and a minimum thickness of the insulating sheet after the insulating sheet is tightened with the screw and is released from the tightening with the screw is equal to or smaller than five times a thickness of the graphite sheet after the insulating sheet is once tightened with the screw and is released from the tightening with the screw.

9. The reactor device according to claim 1, wherein the case includes a peripheral part surrounding the coil, and the insulating sheet is sandwiched between the cooling plate and the peripheral part of the case.

* * * * *